US011939098B2

(12) United States Patent
Breitmar et al.

(10) Patent No.: US 11,939,098 B2
(45) Date of Patent: Mar. 26, 2024

(54) DEVICE AND METHOD FOR RESHAPING THE GABLE SURFACES OF PACKAGES WITH A SLANTED GABLE

(71) Applicant: SIG Technology AG, Neuhausen am Rheinfall (CH)

(72) Inventors: Felix Breitmar, Moenchengladbach (DE); Jürgen Richter, Duesseldorf (DE); Thomas Vetten, Duesseldorf (DE)

(73) Assignee: SIG Technology AG, Neuhausen am Rheinfall (CH)

( * ) Notice: Subject to any disclaimer, the term of this patent is extended or adjusted under 35 U.S.C. 154(b) by 17 days.

(21) Appl. No.: 17/613,269

(22) PCT Filed: Apr. 21, 2020

(86) PCT No.: PCT/EP2020/061037
§ 371 (c)(1),
(2) Date: Nov. 22, 2021

(87) PCT Pub. No.: WO2020/239325
PCT Pub. Date: Dec. 3, 2020

(65) Prior Publication Data

US 2022/0219855 A1 Jul. 14, 2022

(30) Foreign Application Priority Data

May 31, 2019 (DE) ..... 10 2019 114 635.6

(51) Int. Cl.
*B65B 61/24* (2006.01)
*B65B 3/02* (2006.01)

(52) U.S. Cl.
CPC ..... *B65B 61/24* (2013.01); *B65B 3/025* (2013.01)

(58) Field of Classification Search
CPC ..... B65B 3/025; B65B 49/08; B65B 61/24; B65D 5/067; B29L 2031/7166
(Continued)

(56) References Cited

U.S. PATENT DOCUMENTS 2,514,867 A * 7/1950 Howard et al. ..... B65B 7/18 53/375.7
5,000,375 A 3/1991 Farber et al.
(Continued)

FOREIGN PATENT DOCUMENTS

CN 201472732 U 5/2010
CN 108883845 A 11/2018
(Continued)

OTHER PUBLICATIONS

English language translation of CN 201474732 U, EP Office, espacenet.com, 10 pages. (Year: 2023).*

*Primary Examiner* — Stephen F. Gerrity
(74) *Attorney, Agent, or Firm* — The Webb Law Firm

(57) ABSTRACT

A device for post-forming the gable surfaces of packaging with a diagonal gable, including a conveying device with cells secured thereto for receiving the packaging and for transporting the packaging along a transport direction, at least one gable folder for folding a fin seam in the gable region of the packaging, and at least two lug folders for folding lugs in the gable region of the packaging. Both the gable folder and the lug folders are movably mounted relative to the conveyor device and the packaging transported therewith.

14 Claims, 8 Drawing Sheets

(58) Field of Classification Search
USPC .... 53/458, 484, 565, 375.5, 375.7; 493/184, 493/452
See application file for complete search history.

(56) References Cited

U.S. PATENT DOCUMENTS

| | | | | | |
|---|---|---|---|---|---|
| 5,852,919 | A * | 12/1998 | Matsuda et al. | B65B 61/24 | 53/551 |
| 6,560,950 | B1 | 5/2003 | Johansson | | |
| 7,017,796 | B2 * | 3/2006 | Ishikawa | B65D 5/064 | 53/458 |
| 9,475,595 | B2 | 10/2016 | Paradisi et al. | | |
| 10,926,896 | B2 | 2/2021 | Vetten et al. | | |
| 2001/0030106 | A1 * | 10/2001 | Yamamoto et al. | B65B 61/24 | 198/626.1 |
| 2011/0113733 | A1 | 5/2011 | Franic | | |

FOREIGN PATENT DOCUMENTS

| | | | | |
|---|---|---|---|---|
| DE | 7531389 | U | 1/1976 | |
| DE | 3835390 | A1 | 4/1990 | |
| DE | 102013015638 | A1 * | 3/2015 | B65B 61/24 |
| DE | 102016109980 | A1 | 10/2017 | |
| EP | 0061663 | A2 | 10/1982 | |
| EP | 2468641 | A1 | 6/2012 | |
| EP | 3321192 | A1 | 5/2018 | |
| GB | 522143 | | 6/1940 | |
| JP | 2019513636 | A | 5/2019 | |
| WO | 2009030910 | A2 | 3/2009 | |
| WO | 2009141389 | A2 | 11/2009 | |

* cited by examiner

DEVICE AND METHOD FOR RESHAPING THE GABLE SURFACES OF PACKAGES WITH A SLANTED GABLE

CROSS-REFERENCE TO RELATED APPLICATIONS

This application is the United States national phase of International Application No. PCT/EP2020/061037 filed Apr. 21, 2020, and claims priority to German Patent Application No. 10 2019 114 635.6 filed May 31, 2019, the disclosures of which are hereby incorporated by reference in their entirety.

BACKGROUND OF THE INVENTION

1. Field of the Invention

The invention relates to a device for reshaping the gable surfaces of packages with a slanted gable, comprising: a conveyor apparatus with cells fastened thereto for receiving the packages and for transporting the packages along a direction of transport, at least one gable folder for folding a fin seam in the gable region of the packages, and at least two ear folders for folding ears in the gable region of the packages, wherein both the gable folder and the ear folders are mounted in a movable manner relative to the conveyor apparatus and the packages transported therewith.

The invention further relates to a method for reshaping the gable surfaces of packages with a slanted gable, comprising the following steps: a) providing packages with slanted gables, b) folding the fin seam in the gable region of the packages by means of a gable folder, c) folding the ears in the gable region of the packages by means of two ear folders, and d) reshaping the fin seam by means of a forming tool.

2. Discussion of the Related Art

Packages can be manufactured in different ways and from an extremely wide range of materials. A common option for manufacturing is to manufacture a blank having normal fold lines (also known as a "crease lines") from the packaging material from which initially a package sleeve and ultimately the package itself can be created by means of folding and further steps. Among other things, this variant has the advantage that the blanks are very flat and can therefore be stacked in a manner which saves space. In this way, the blanks or package sleeves can be manufactured in a different location to that where the folding and filling of the package sleeves takes place. Composite materials are often used as the material, for example a composite made of several thin layers of paper, cardboard, plastic or metal. Such packages are widely used in the foodstuffs industry in particular.

Packages made from blanks are known, for example, from WO 2009/141389 A2 and DE 38 35 390 A1. These packages predominantly have gable surfaces which rise at an identical angle towards the middle on both sides and are therefore symmetrically shaped. The fin seam is therefore the highest point of the package, at least before it is folded.

When manufacturing packages of this type, there is a challenge of creating protruding regions such as seams or "ears" on the package. In the case of cuboid packages, this is possible in a very simple manner; a machine to do this is known for example from EP 0 061 663 A2.

Packages with asymmetrical—in other words slanted—gables can also be manufactured from blanks. Packages of this type are known for example from WO 2009/030910 A2 and EP 2 468 641 B1. In these packages, the creation of protruding regions is particularly difficult as it is often not the fin seam but rather the rear edge of the gable which forms the highest point of the package in slanted gable packages of this type. This leads to the fin seam being more difficult for tools to access. In particular, the fin seam cannot be applied by a fixed tool which the package passes in these types of packages. A device and a method for shaping the gable surfaces of such slanted gable packages is for example known from DE 10 2016 109 980 A1.

Although the device described in DE 10 2016 109 980 A1 and the method described therein provide good results, the shape of the gable may once again arch outwards after shaping. In particular, it is occasionally observed that the gable seam or fin seam is either not completely applied to the gable or moves out of the applied position. This can for example be caused by the internal pressure of the package or a consequence of the pressing of the ears onto the side surfaces of the package. An uneven gable surface is not only visually unacceptable, but also makes it difficult to subsequently apply further elements, for example dispensing elements with screw caps.

Against this background, the object underlying the invention is to maintain and/or correct the shape of the gable in packages with a slanted gable.

SUMMARY OF THE INVENTION

This object is achieved in a device according to the invention herein, by at least one forming tool for reshaping the fin seam in the gable region of the packages, wherein the forming tool is mounted in a movable manner relative to the conveyor apparatus and the packages transported therewith.

The device is a device for the reshaping gable surfaces of packages with a slanted gable, in particular with a continuously slanted gable. In particular, the fin seam is (re)shaped in the gable region of the package, wherein reshaping describes a shaping of previously shaped, in particular folded regions. In addition, the entire gable surface is (re)shaped, for example, in order to stabilise certain folding edges. The package is preferably a package for foodstuffs made of a composite material. The composite material can have a plurality of thin layers made of paper, cardboard, plastic or metal. The device initially comprises a conveyor apparatus with cells fastened thereto to receive the packages and to transport the packages along a direction of transport. Through a conveyor apparatus (for example a transport belt, a conveyor belt or a transport chain), high tensile forces can be transferred enabling a plurality of package sleeves to be transported at constant distances from one another. The cells are used to receive the package sleeves. The package sleeves can be held in the cells either by means of a positive-locking connection or by means of a frictional connection. The conveyor apparatus is preferably arranged in a horizontal plane. The device also comprises at least one gable folder for folding a fin seam in the gable region of the packages. The gable folder is preferably arranged centrally above the conveyor apparatus and the packages transported thereon. In addition to this, the device comprises at least two ear folders to fold ears in the gable region of the packages. The two ear folders are preferably arranged above the conveyor apparatus and the packages transported thereon on both sides adjacent to the gable folder. The invention provides for both the gable folder and the ear folders to be mounted in a movable manner relative to the conveyor apparatus and the packages transported therewith.

A device according to the invention is characterised by at least one forming tool for reshaping the fin seam in the gable region of the packages, wherein the forming tool is mounted in a movable manner relative to the conveyor apparatus and the packages transported therewith. In addition to reshaping the fin seam, the forming tool is also used to reshape the gable surface. A processing station with such a forming tool can also be referred to as a "post-pressing station" or "reshaping station". In other words, the forming tool, just like the gable folder and the ear folders, should be mounted in a rotatable, pivotable, displaceable or otherwise movable manner. Through this design measure, it is possible that the relative movement between the forming tool and the package required for the reshaping is achieved by a movement of the forming tool and not by a movement of the package. As a result, the package does not need to be moved during the shaping or reshaping, so the conveyor apparatus can be still. The conveyor apparatus can therefore be operated in an intermittent, cyclical manner. Shaping a package that is not moving has the advantage that the packages can be filled particularly easily as the filling apparatus does not have to be moved as well. A further advantage is that as a result of the folding tools being mounted in a movable manner, packages can also be shaped in which the rear edge of the gable rather than the fin seam forms the highest point of the packages.

According to one configuration of the device, the forming tool for reshaping the fin seam has at least two-dimensional mobility. This can for example be achieved by the forming tool being mounted in a movable manner in a plane (in particular rotatably), in particular in a plane formed by the direction of transport and the vertical direction of the packages. The forming tool should therefore not merely be able to be displaced in a linear direction but should also have at least two-dimensional mobility. In the plane of movement, the forming tool can make translational movements, rotational movements or combinations of the two (overlapping of translational and rotational movements). The plane of movement of the forming tool is preferably formed by the direction of transport and the vertical direction of the packages.

A further design of the device is characterised by a traverse which is arranged above the cells and extends along a transverse direction running transversely to the direction of transport. The use of a traverse has the advantage that a traverse can extend over a plurality of parallel rows or strips of packages to be transported, so that when a corresponding number of tools (e.g. forming tools) are fastened to the traverse, a plurality of strips of packages can be processed simultaneously. A plurality of traverses can be provided, for example a first traverse for mounting the gable folders and a second traverse for mounting the (re)forming tools.

For this design, it is further proposed that the traverse is mounted in a movable manner relative to the conveyor apparatus and the packages transported therewith. A movable mounting of the traverse offers different advantages. One advantage is that the forming tools can be rigidly connected to the traverse and can therefore be mounted in an immovable manner relative to the traverse. This is because the forming tools remain movable, even with a rigid connection to the traverse, due to the mobility of the traverse relative to the conveyor apparatus and the packages transported therewith. A further advantage of a movable mounting of the traverse is that the traverse can be adjusted to different package sizes. In the case of a "format change", it is therefore not necessary to replace the traverse; instead, the height of the traverse can be adjusted, for example. Preferably, the traverse is mounted in a movable manner, i.e. in the vertical direction, relative to the conveyor apparatus and the packages transported therewith.

With regard to the traverse, in a further configuration of the device, at least two, in particular at least four forming tools are provided for reshaping the fin seam in the gable region of the packages, wherein all forming tools are mounted next to one another on the traverse in a transverse direction. This embodiment allows a plurality of packages to be processed simultaneously. For example, a plurality of conveyor belts running parallel can be provided. Preferably, a forming tool is assigned to each series of packages to be processed.

According to a further configuration of the device, the gable folder and the forming tool and/or their traverses are coupled to one another by a mechanical connection and have a common drive. Synchronous movement of these tools can be achieved by mechanically coupling the tools (gable folder, forming tool). This makes it possible for all tools to use the same drive. Mechanical coupling can be carried out by the tools themselves or by the traverses on which the tools are mounted.

According to a further design of the device, the forming tool comprises a mould carrier and a support. A multi-part structure of the forming tool can be used to make it easier to adapt to differently shaped packages by replacing the supports whose profiles are adapted to different gable surfaces. The mould carrier is preferably made of metal and serves to support different supports. The replaceable support is preferably made of silicone, plastic, rubber or another elastic or expandable material or at least coated with it (e.g. metal core with coating).

In a further configuration of the device, it is provided that the cells have a distance to one another and that the forming tool has at least twice the cell distance to the gable folder and/or to the ear folders. Spacing the tools means that the reshaping by the forming tool does not immediately follow the folding of the gable and the ears, but takes place at the earliest two "cycles" afterwards. This has the advantage that the temperature of the package in the gable region has already cooled slightly and the ears are firmly applied. On the other hand, (re)shaping that takes place too early would have the disadvantage that the adhesion process of the ears has not yet been completed, which could result in the ears coming away from the packaging again. In addition, it is difficult to arrange the (re)forming tools directly behind the gable shaping station due to the installation space requirements.

The object described at the outset is also achieved by a method for reshaping the gable surfaces of packages with a slanted gable, comprising the following steps: a) providing packages with slanted gables, b) folding the fin seam in the gable region of the packages by means of a gable folder, c) folding the ears in the gable region of the packages by means of two ear folders, and d) reshaping the fin seam by means of a forming tool. The method is characterised in that in step d) the forming tool is moved relative to the conveyor apparatus and the packages transported therewith. The packages can in particular be provided by means of a conveyor apparatus in the form of a conveyor belt or a transport belt or a transport chain with cells fastened thereto to receive the packages. The conveyor belt or transport belt or transport chain is preferably arranged in a horizontal plane. As already described in connection with the device, the relative movement between the forming tools and the packages necessary for the shaping should be achieved by means of a movement of the forming tools and not by means of a movement of the package. As a result, the package does not have to be moved during shaping, enabling the conveyor apparatus to be operated in an intermittent, cyclical manner. Shaping while the package is not moving has the advantage that filling can also be carried out without the package moving, and the processing of packages is also possible in which it is not the fin seam, but rather the rear edge of the gable that forms the highest point of the packages. The method is preferably carried out with a device according to the invention.

In accordance with one configuration of the method, the packages are moved by means of a conveyor apparatus with cells fastened thereto. As already described in connection with the device, through a conveyor apparatus (for example a transport belt, a conveyor belt or a transport chain), high tensile forces can be transferred enabling a plurality of package sleeves to be transported at constant distances from one another. The cells are used to receive the package sleeves. The package sleeves can be held in the cells either by means of a positive-locking connection or by means of a frictional connection. The conveyor apparatus is preferably arranged in a horizontal plane.

In accordance with a further development of the method, the packages are moved intermittently. Intermittent, in other words cyclical, operation has the advantage that the packages are briefly still and more precise processing can be carried out during this phase.

A further advantage is that the tools used to process the packages do not have to be moved along with the packages.

A further configuration of the method provides for the packages to be still during step b), during step c) and during step d). Steps b) and c) are used to move the fin seam and apply the protruding ears, while step d) is used to reshape the gable surface, in particular the fin seam. These steps should be carried out in as precise and rapid a manner as possible without damaging or deforming the packages. These requirements are easier to meet when the packages are not moving than when the packages are constantly moving.

In accordance with a further development of the method, the gable surfaces of at least two, in particular of at least four packages, are reshaped simultaneously in step d). This further development means that a plurality of packages can be processed simultaneously. In order to do this, a plurality of conveyor belts running parallel can, for example, be provided. Preferably, a forming tool is assigned to each series of packages to be processed.

Finally, according to a further configuration of the method, step d) is carried out at a location which has at least twice the cell distance (A) from the location at which step b) and/or step c) is carried out. By maintaining a minimum distance between the processing locations, the reshaping by the forming tool does not take place too close behind the folding of the gable and of the ears, but only two "cycles" afterwards or even later. This has the advantage that the temperature of the package in the gable region has already cooled slightly and the ears are firmly applied. On the other hand, (re)shaping that takes place too early would have the disadvantage that the adhesion process of the ears has not yet been completed, which could result in the ears coming away from the packaging again. In addition, it is difficult to arrange the (re)forming tools directly behind the gable shaping station due to the installation space requirements.

BRIEF DESCRIPTION OF THE DRAWINGS

The invention will be explained in more detail below with reference to a drawing which simply represents a preferred exemplary embodiment, in which.

DETAILED DESCRIPTION OF THE PREFERRED EMBODIMENTS

Figure 1A:
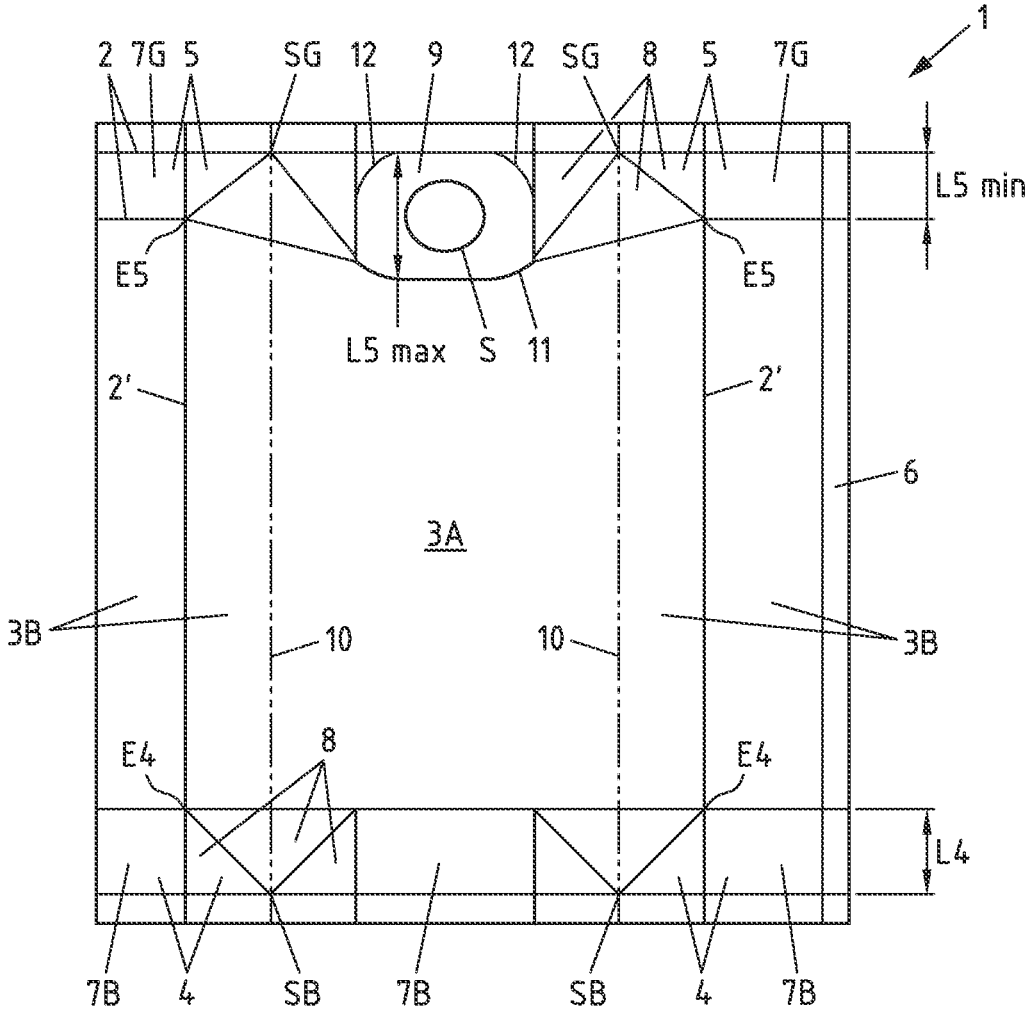
FIG. 1A: shows a blank for folding a package sleeve.

FIG. 1A shows a blank 1 for folding a package sleeve. The blank 1 can comprise a plurality of layers of different materials, for example paper, cardboard, plastic or metal, in particular aluminium. The blank 1 has a plurality of fold lines 2 which are intended to facilitate the folding of the blank 1 and which divide the blank 1 into a plurality of surfaces. The blank 1 can be subdivided into a sleeve surface 3, base surface 4, gable surfaces 5 and a sealing surface 6. The base surfaces 4 and the gable surfaces 5 each comprise rectangular surfaces 7, 7B, 7G and triangular surfaces 8. The gable surfaces 5 also comprise a centrally arranged main gable surface 9. With the exception of the sealing surface 6, the sleeve surface 3 extends over the entire width of the blank 1. A package sleeve can be formed from the blank 1 by the blank 1 being folded in such manner that the sealing surface 6 is joined, in particular fused, to the opposite end of the sleeve surface 3.

The blank 1 shown in FIG. 1A has two secondary fold lines 10 in the region of the sleeve surface 3. Both secondary fold lines 10 run parallel to one another and through a contact point SB of three adjacent triangular surfaces 8 of the base surface 4 and through a contact point SG of three adjacent triangular surfaces 8 of the gable surfaces 5. The sleeve surface 3 is divided into an inner partial region 3A and into two outer partial regions 3B by the secondary fold lines 10. The inner partial region 3A is between the two secondary fold lines 10 and the outer partial regions 3B are outside of the two secondary fold lines 10.

While the base surface 4 has a length L4 which is constant over the entire width of the blank 1, the length of the gable surface 5 has different values. The gable surface 5 has a decreased length $L5_{min}$ adjoining the outer partial regions 3B of the sleeve surface 3. However, adjoining the inner partial region 3A of the sleeve surface 3 (in other words in the region of the main gable surface 9), the gable surface 5 has an increased length $L5_{max}$. This design means that the inner partial region 3A has a lower height than the outer partial regions 3B. For the package to be manufactured, this results in an inclined, slanted gable region which slopes in a forward direction.

The rectangular surfaces 7B in the base region of the blank are rectangular. Both external rectangular surfaces 7G in the gable region of the blank are also rectangular. In contrast, the middle main gable surface 9 is not exactly rectangular; it is instead formed with a front edge 11 which is convexly bent at least in sections. In the upper corner regions of the main gable surface 9, two curved embossing lines 12 are discernible, which give the main gable surface 9 a design reminiscent of an ellipse. A circle-shaped tear line S is shown centrally inside the main gable surface 9. This is preferably a circular recess in the carrier material which is spanned with the remaining plastic and where applicable aluminium layers of the composite material forming what is known as a "over coated hole". Its diameter can be adapted to the size of the cutting element of a dispensing element to be applied there or can be designed to be relatively small to enable a straw to penetrate it.

The base surfaces 4 have two corner points E4 and the gable surfaces 5 have two corner points E5. The corner points E4, E5 are corner points of the package to be manufactured from the blank 1. Each corner point E4 of a base surface 4 is assigned a corresponding corner point E5 of a gable surface 5 which is in each case the corner point E5 which is arranged above this corner point E4 when the packages is standing up. A fold line 2' runs through two corresponding corner points E4, E5 in each case and is used to form a rear (vertically running) edge of the package to be manufactured. However, there are only two continuous fold lines 2' in the blank 1 shown in FIG. 1A, just like in the case of the package sleeve manufactured therefrom and the package manufactured therefrom. However, no fold lines are provided between the further corner points of the base surfaces 4 and the corresponding corner points of the gable surfaces 5, in other words on the front sleeve surface 3A.

Figure 1B:
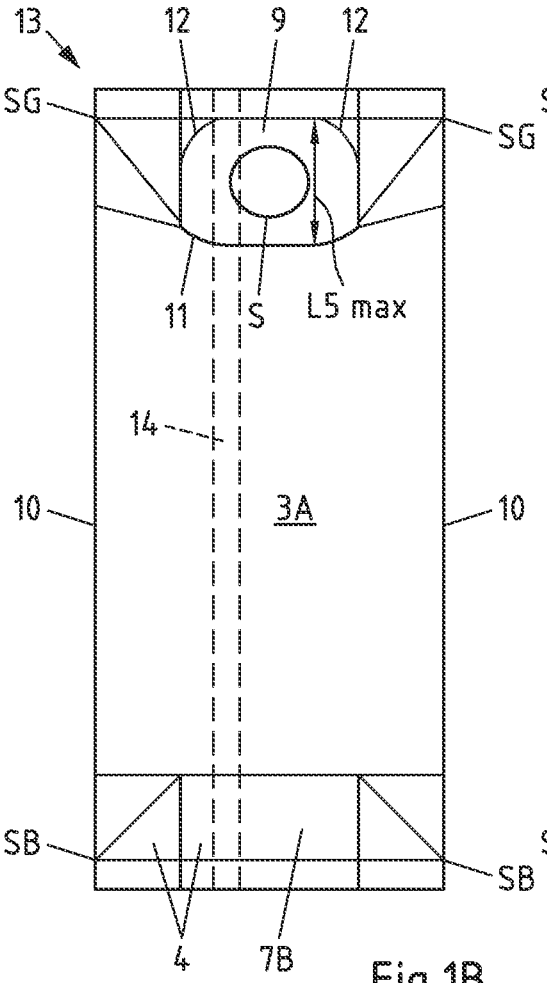
FIG. 1B: shows a front view of a package sleeve, which is formed from the blank shown in FIG. 1A, in the folded-flat state.

FIG. 1B shows a front view of a package sleeve 13, which is formed from the blank 1 shown in FIG. 1A, in the folded-flat state. The regions of the package sleeve already described in connection with FIG. 1A are provided with corresponding reference numerals in FIG. 1B. The package sleeve 13 is created from the blank 1 in two steps: The blank 1 is first folded along the two secondary fold lines 10. The two partial regions 3B (left) and 3B (right) of the sleeve surface 3 are then joined together, in particular welded, in the region of the sealing surface 6, resulting in a longitudinal seam 14 (hidden in FIG. 1B). The package sleeve 1 therefore has a circumferential structure which is closed in a circumferential direction with an opening in the region of the base surfaces 4 and with an opening in the region of the gable surfaces 5. The inner partial region 3A of the sleeve surface 3 is visible in the front view, both sides of which are delimited by the secondary fold lines 10. The remaining partial regions 3B of the sleeve surface 3 are on the back of the package sleeve 13 and therefore hidden in FIG. 1B.

Figure 1C:
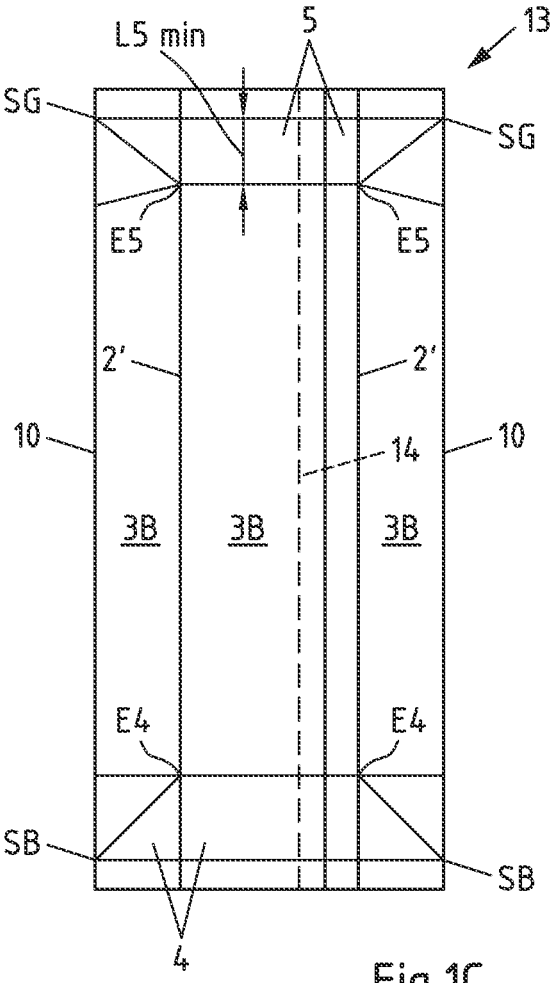
FIG. 1C: shows a rear view of the package sleeve from FIG. 1B, FIG. 1D: shows the package sleeve from FIG. 1B and FIG. 1C in the unfolded state.

FIG. 1C is a rear view of the package sleeve 13 from FIG. 1B. The regions of the package sleeve already described in connection with FIG. 1A and FIG. 1B are provided with corresponding reference numerals in FIG. 1C. Both external partial regions 3B of the sleeve surface 3 are visible in the rear view. They are joined together by means of the longitudinal seam 14 and are delimited on both sides by the secondary fold lines 10. The front partial region 3A of the sleeve surface 3 is on the front of the package sleeve 13 and therefore hidden in FIG. 1C.

Figure 1D:
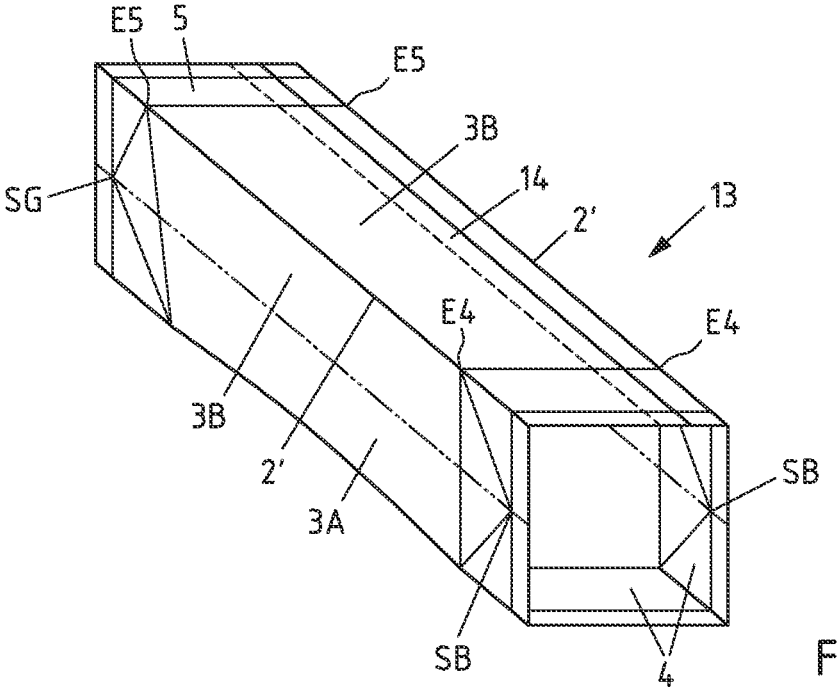
FIG. 1E: shows the package sleeve from FIG. 1B to FIG. 1D with the base closed.
FIG. 1F: shows the package sleeve from FIG. 1B to FIG. 1E with pre-folded gable surfaces.
FIG. 1G: shows a package manufactured from the package sleeve shown in FIG. 1B to FIG. 1F with an unshaped gable.
FIG. 1H: shows the package from FIG. 1G with a shaped gable.
FIG. 1I: shows a cross-sectional view of the package from FIG. 1G along the cut line E shown in FIG. 1H, FIG. 2: shows a lateral view of a system for filling and sealing packages.

FIG. 1D shows the package sleeve 13 from FIG. 1B and FIG. 1C in the unfolded state. The regions of the package sleeve already described in connection with FIG. 1A to FIG. 1C are provided with corresponding reference numerals in FIG. 1D. The unfolded state is achieved by folding back the package sleeve 13 along the secondary fold lines 10 running through the sleeve surface 3. The sleeve is folded back by around 180°. This folding back along the secondary fold lines 10 results in the two partial regions 3A, 3B of the sleeve surface 3 adjoining the secondary fold lines 10 no longer lying flat on top of one another but rather being arranged in the same plane. The package sleeve 13 is therefore only in its flat state (FIG. 1B, FIG. 1C) along the secondary fold lines 10; in the unfolded state (FIG. 1D), on the other hand, the package sleeve 13 (just like the package to be produced therefrom) is no longer folded along the secondary fold lines 10. This is why they are called "secondary" fold lines 10.

Figure 1E:
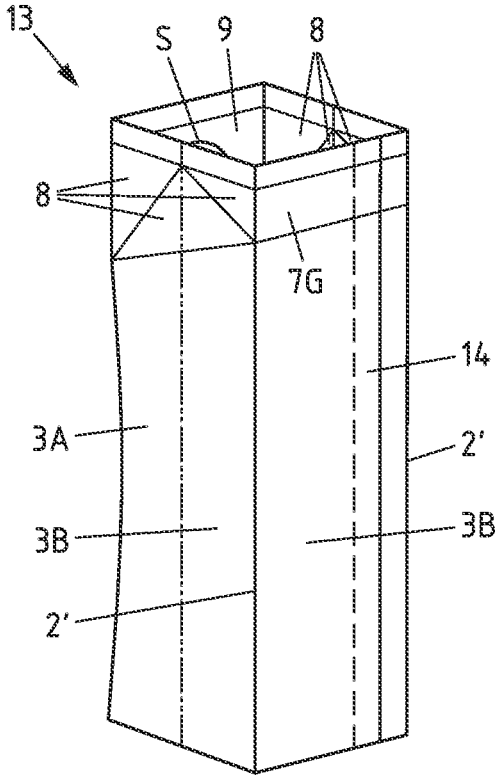

FIG. 1E shows the package sleeve from FIG. 1B to FIG. 1D with the base closed. The regions of the package sleeve already described in connection with FIG. 1A to FIG. 1D are provided with corresponding reference numerals in FIG. 1D. The base can for example be sealed while the unfolded package sleeve 13 is pushed onto a mandrel of a mandrel wheel. In order to seal the base, the lower triangular surfaces 8 are for example first folded inwards before the lower rectangular surfaces 7B are folded inwards. The surfaces folded together are then fused by means of pressure and temperature.

Figure 1F:
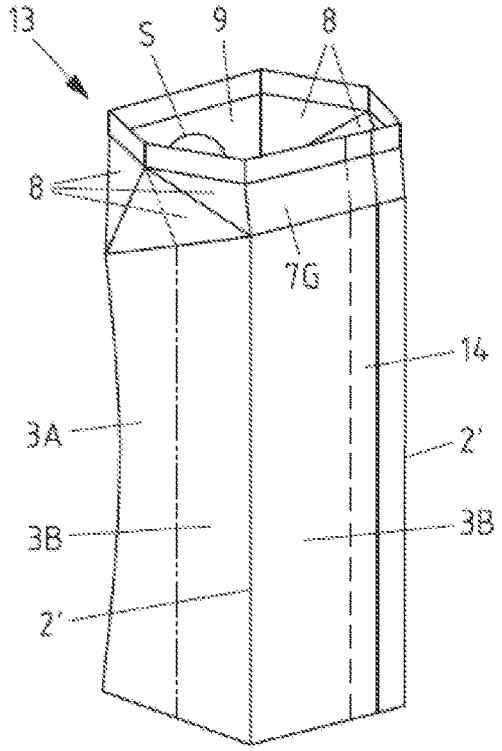

FIG. 1F shows the package sleeve from FIG. 1B to FIG. 1E with pre-folded gable surfaces. The regions of the package sleeve already described in connection with FIG. 1A to FIG. 1E are provided with corresponding reference numerals in FIG. 1F. "Pre-folded state" means a state in which the two fold lines 2 in the region of the gable surfaces 5 have been pre-folded. The rectangular surface 7G and the main gable surface 9 are folded inwards during the pre-folding and later form the gable of the package. The triangular surfaces 8, however, are folded outwards during the pre-folding and form protruding regions of excess material which are also known as "ears" 15 and are placed on the sleeve surface 3 of the package in a subsequent manufacturing step, for example by means of an adhesion process.

Figure 1G:
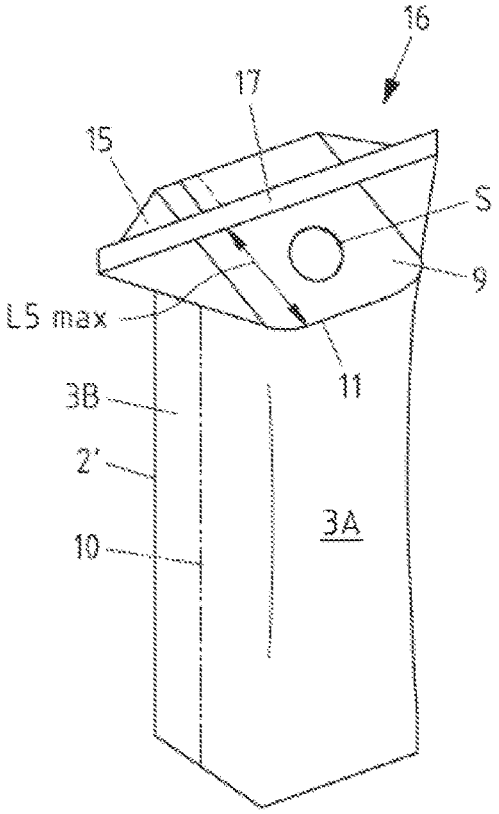

FIG. 1G shows a package 16 manufactured from the package sleeve 13 shown in FIG. 1B to FIG. 1F with an unshaped gable. The regions of the package already described in connection with FIG. 1A to FIG. 1F are provided with corresponding reference numerals in FIG. 1G. The package 16 is shown after fusing, i.e. in the filled and sealed state. An enlarged main gable surface 9 is generated as a result the enlarged length $L5_{max}$ of the main gable surface 9 in its region adjoining the inner partial region 3A of the sleeve surface 3 and the decreased length $L5_{min}$ of the gable surface 5 in its region adjoining the outer partial regions 3B of the sleeve surface 3. The package 16 can be provided with a dispensing element on this main gable surface 9 which stretches almost to the front edge 11 which is arched forwards. A fin seam 17 is generated in the region of the gable surfaces 5 after sealing. In FIG. 1G, the ears 15 and the fin seam 17 both protrude. The ears 15 are applied in a subsequent manufacturing step, for example by means of an adhesion process, resulting in the fin seam 17 automatically also remaining in a flat position.

Figure 1H:
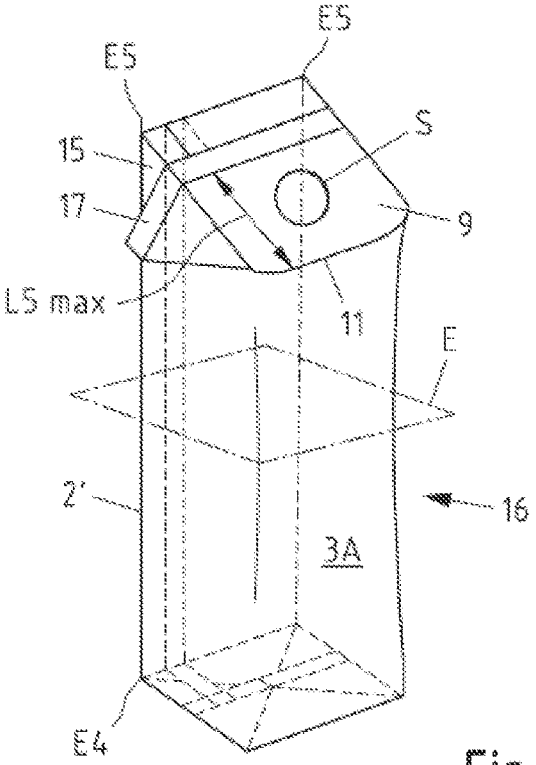
Figure 1I:
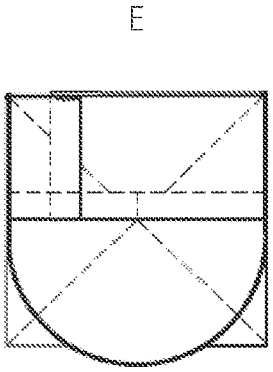

FIGS. 1H and 1I show the package 16 from FIG. 1G with the shaped gable, in particular with the ears 15 applied. The regions of the package already described in connection with FIG. 1A to FIG. 2G are provided with corresponding reference numerals in FIG. 1H. In addition to the ears 15, the fin seam 17 is also applied to the package 16. The upper ears 15 arranged in the region of the gable surface 5 are folded down and applied flat to the sleeve surface 3. The ears 15 are preferably adhered or fused to the sleeve surface 3. The package 16 shown in FIG. 1H does not have any folding edges in the region of the front sleeve surface 3A. The front of the package which is curved forwards can clearly be recognised in the horizontal section through the plane E of the package shown on the right. The straight fold lines 2' on the rear package edges run from the lower corner points E4 to the upper corner points E5.

Figure 2:
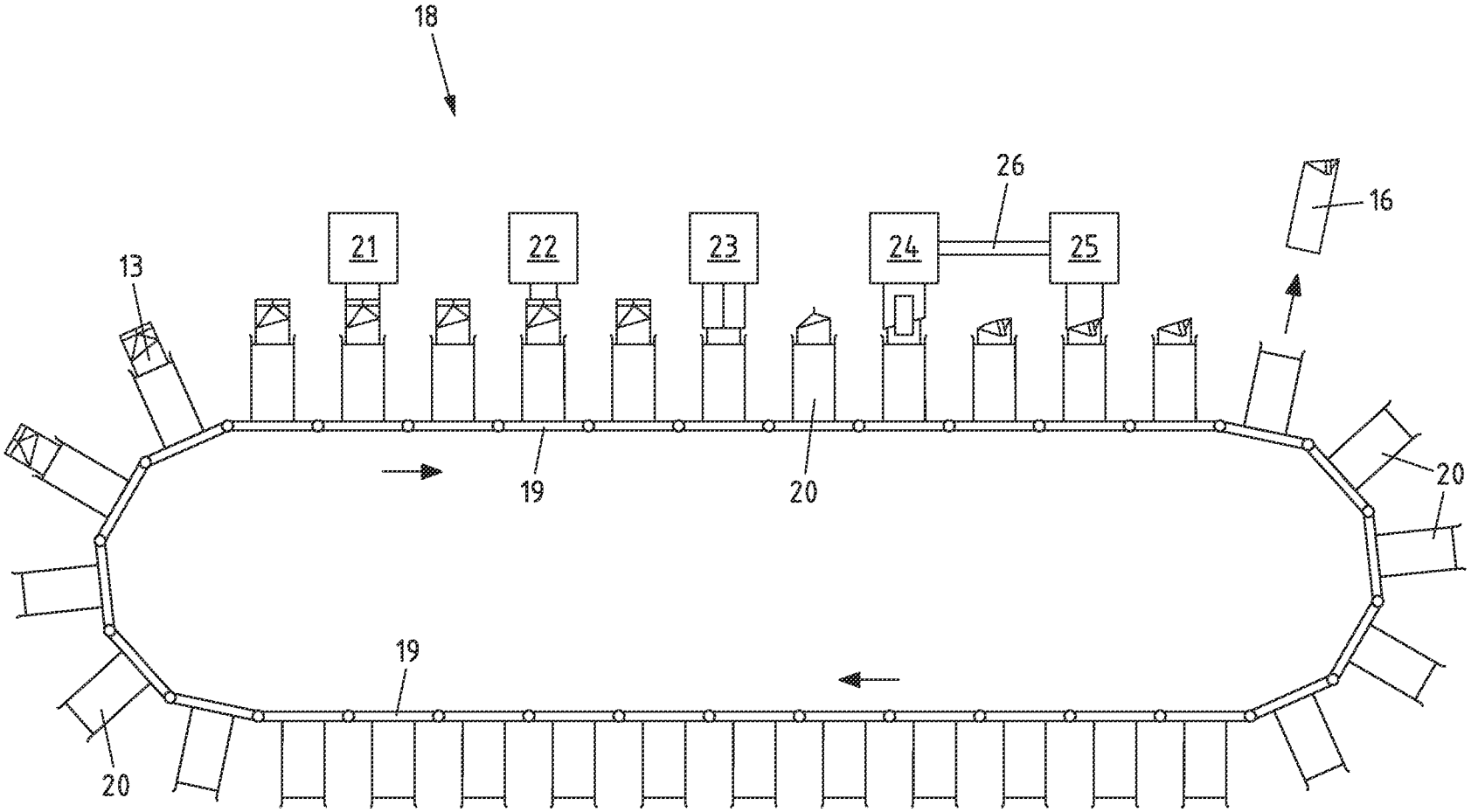

FIG. 2 is a lateral view of a system 18 for filling and sealing packages. The system 18 comprises a circumferential conveyor apparatus 19 with cells 20 fastened thereto to receive package sleeves 13. The package sleeves 13 are inserted into the cells 20 in the state shown in FIG. 1E, in other words with the base surfaces already sealed. The system 18 comprises a device 21 for pre-folding the gable surfaces, a device 22 for filling the package sleeves, a device 23 for sealing the package sleeves, a device 24 for shaping the gables of the packages 16 and a device 25 for reshaping the gables of the packages 16. The gable surfaces are pre-folded in the manner described above in the device 21 for pre-folding the gable surfaces, with the package sleeves 13 taking the shape shown in FIG. 1F. The package sleeves 13 are filled with contents in the device 22 for filling the package sleeves. The package sleeves 13 are then sealed in the device 23 for sealing the package sleeves, wherein they take the shape shown in FIG. 1G. After sealing, the package sleeves 13 are then called packages 16. The packages 16 are then processed in the device 24 for shaping the gables of the packages in such manner that they take the shape shown in FIG. 1H. The processing includes folding over the fin seam 17 and applying the ears 15. The packages 16 are then processed in the device 25 in such manner that the gables of the packages 16, in particular the fin seams 17 arranged there, are shaped again in order to bring them into the desired shape. The packages 16 are then removed from the cells 20 of the conveyor apparatus 19. As in FIG. 2, it can only schematically be discerned that the device 24 and the device 25 have a mechanical connection 26. In this way, the device 24 and the device 25 can be mechanically coupled to one another and driven by the same drive.

Figure 3:
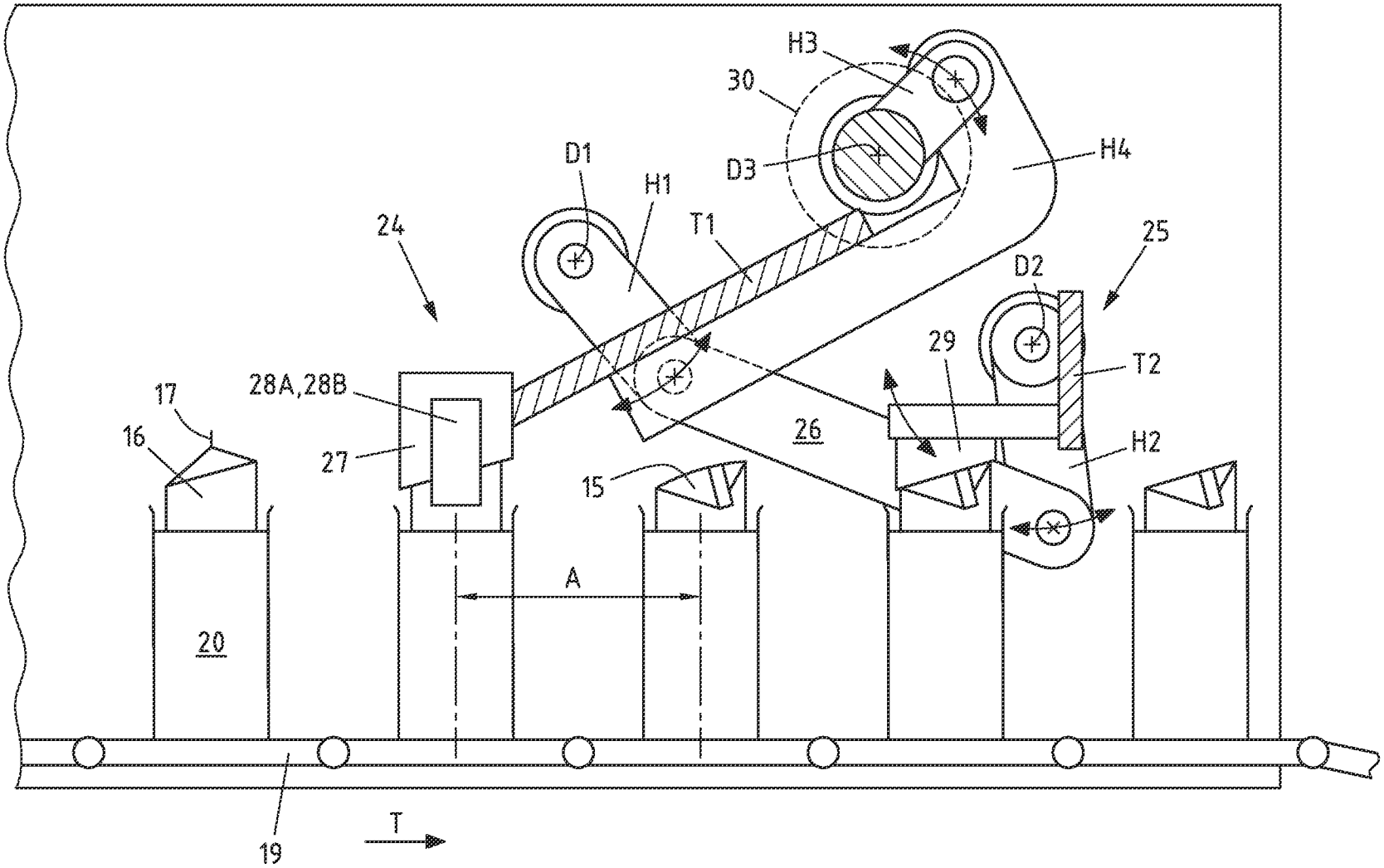
FIG. 3: shows an enlarged section of the system from FIG. 2, FIG. 4A: shows a lateral view of a device according to the invention for reshaping the gable surfaces of packages with a slanted gable in an open position.

FIG. 3 shows an enlarged section of the system 18 for filling and sealing packages from FIG. 2. The regions of the system 18 already described in connection with FIG. 2 are provided in FIG. 3 with corresponding reference numerals. The enlarged section shows in particular the region of the system 18 in which the device 24 and the device 25 are arranged. The packages 16 are transported by the conveyor apparatus 19 at a distance A from one another along a direction of transport T, wherein the distance A designates the distance between two adjacent cells 20 in the direction of transport T.

The device 24 for shaping the gables of the packages 16 has a gable folder 27 for folding the fin seam 17 in the gable region of the packages 16. The device 24 also has two ear folders 28A, 28B for folding the ears 15 in the gable region of the packages 16. Furthermore, the device 24 comprises a traverse T1 on which the gable folders 27 are mounted. The traverse T1 is movably mounted relative to the conveyor apparatus 19, which, in the case of the exemplary embodiment shown in FIG. 3, is achieved in that the traverse T1 is fixedly mounted on a lever arm H4, which is rotatably connected to a further lever arm H3, which can be rotated about a stationary axis of rotation D3. A rotation of the lever arm H3 about the stationary axis of rotation D3 therefore results in a movement of the traverse T1 and of the gable folders 27. The structure and functioning of this device 24, also referred to as "gable shaping station", are described, for example, in DE 10 2016 109 980 A1.

For this purpose, the device 25 for reshaping the gables of the packages 16 has a forming tool 29. Furthermore, the device 25 comprises a traverse T2 on which forming tools 29 are mounted. The traverse T2 is mounted in a movable manner relative to the conveyor apparatus 19, which, in the case of the exemplary embodiment shown in FIG. 3, is implemented by means of a lever arm H2 which can be rotated about a stationary axis of rotation D2. The device 24 (in particular its gable folder 27) and the device 25 are driven by a common drive 30, which can for example be designed as an electric motor. In particular the gable folders 27 of the device 24 should be driven together with the device 25 and its forming tools 29, while the ear folders 28A, 28B of the device 24 preferably have a separate drive. The drive 30 can rotate about a stationary axis of rotation D3 and can transfer its drive power via rotatably interconnected lever arms H3, H4 to one of the two devices 24, 25 (in FIG. 3: transfer of drive power to the traverse T1 of the device 24). The mechanical connection 26 connects the lever arm H1 of the device 24 to the lever arm H2 of the device 25 and thus ensures that the drive power of the drive 30 is transferred to both devices 24, 25 so that both devices 24, 25 can be driven, in part or in full, by the same drive 30. For this purpose, the mechanical connection 26 is designed like a coupling rod, which is rotatably connected at both ends to the lever arms H1, H2 to be connected.

Figure 4B:
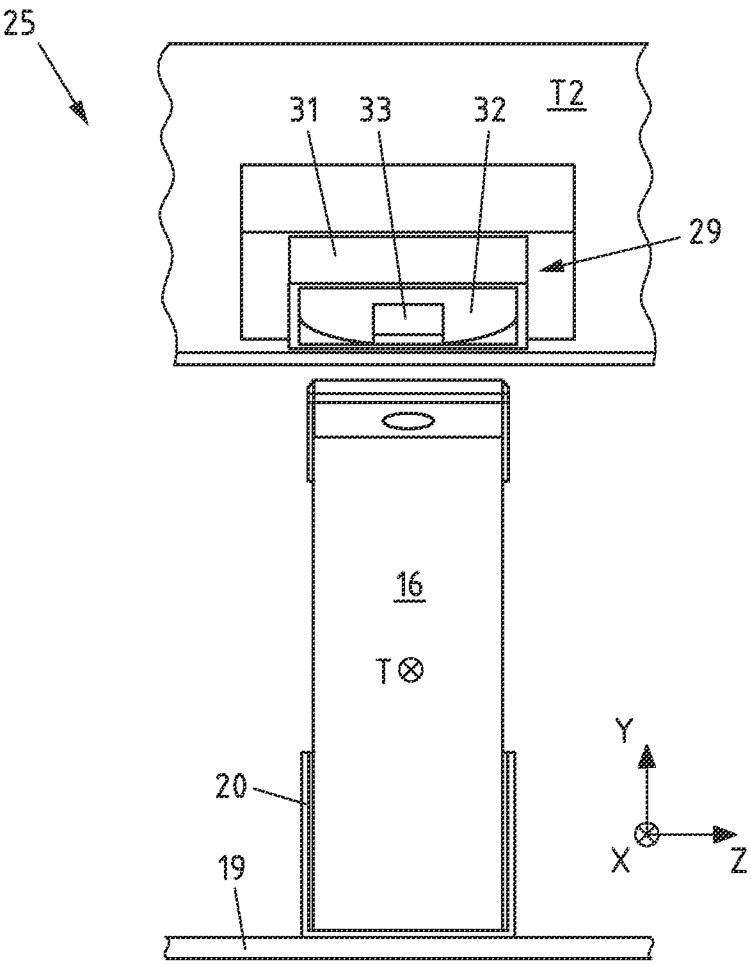
FIG. 4B: shows a front view of the device from FIG. 4A, FIG. 4C: shows a lateral view of a device according to the invention for reshaping the gable surfaces of packages with a slanted gable in a closed position
Figure 4A:
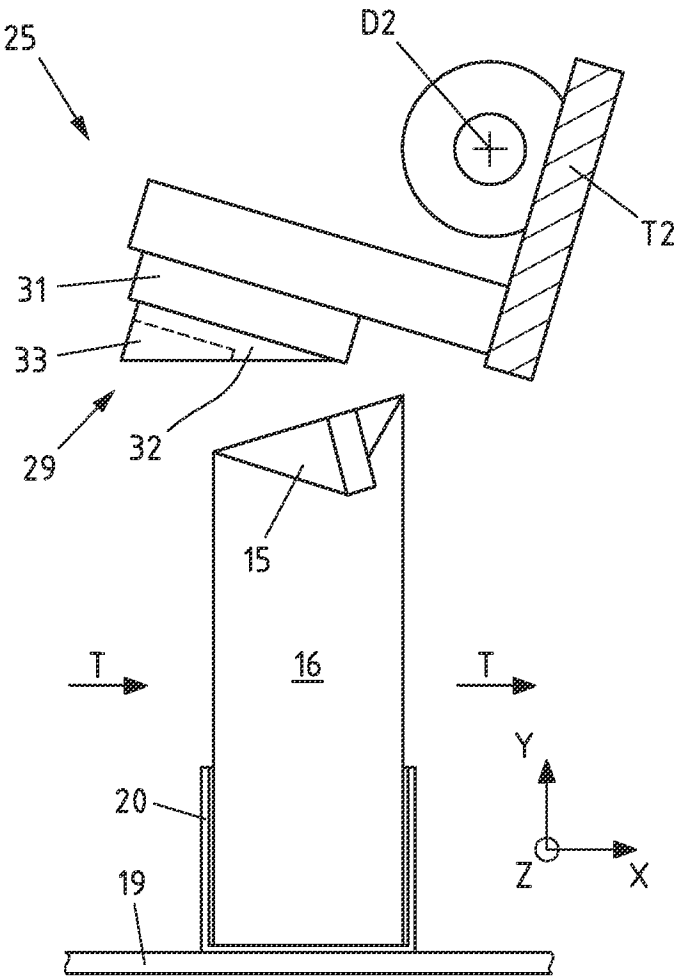
FIG. 4D: shows a front view of the device from FIG. 4C.

FIG. 4A shows a lateral view of a device 25 according to the invention for reshaping the gable surfaces of packages 16 with a slanted gable in an open position. FIG. 4B shows a front view of the device 25 from FIG. 4A. The device 25 comprises a forming tool 29 which is fastened to a traverse T2, which can be pivoted about an axis of rotation D2. The forming tool 29 is thus mounted in a movable manner relative to the conveyor apparatus 19 and the packages 16 transported therewith. The forming tool 29 comprises a mould carrier 31 and a support 32, which has a recess 33. The movable mounting of the forming tool 29 has the advantage that the gable surface and in particular the fin seam 17 can easily be reached although it can be arranged lower than the highest edge of the package 16. The forming tool 29 is mounted in such manner that it can be moved in a plane which is formed by the longitudinal direction corresponding to the direction of transport of the packages 16 (shown as the X direction in FIG. 4A to FIG. 4D) and the vertical direction (shown as the Y direction in FIG. 4A to FIG. 4D). Accordingly, the forming tool 29 has two-dimensional mobility. The open position of the device represented in FIG. 4A and FIG. 4B is characterised in that the forming tool 29 does not touch the package 16 and in that the package 16 can be moved under the forming tool 29 in the direction of transport T without collision.

Figure 4D:
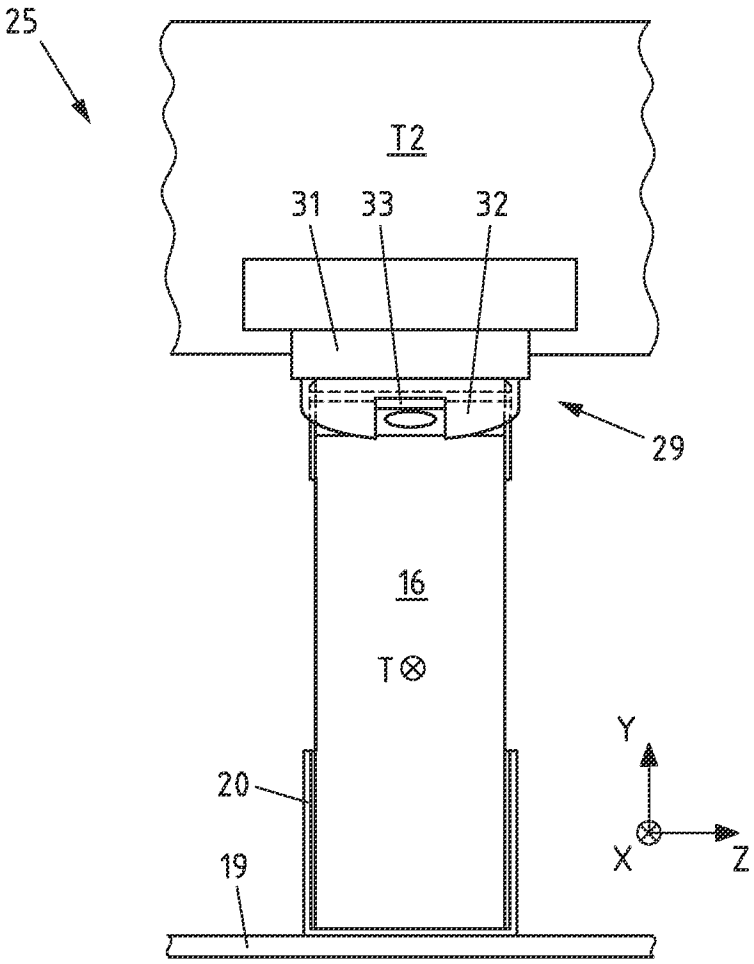
Figure 4C:
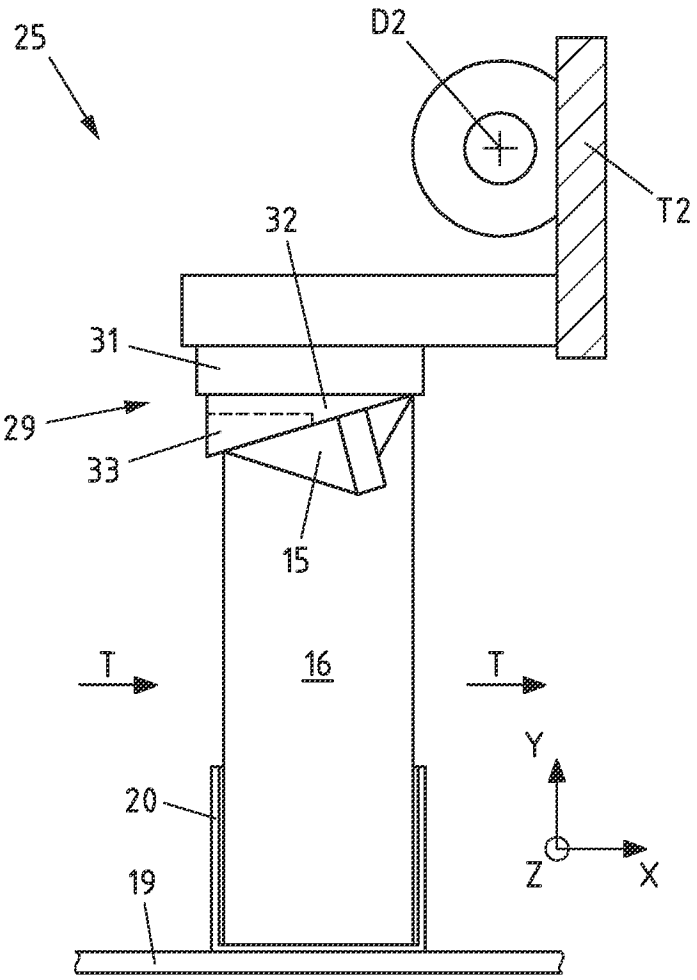

FIG. 4C is a lateral view of a device 25 according to the invention for reshaping the gable surfaces of packages 16 with a slanted gable in a closed position. FIG. 4D is a front view of the device 25 from FIG. 4C. The regions of the device already described in connection with FIG. 4A and FIG. 4B are provided in FIG. 4C and FIG. 4D with corresponding reference numerals. The closed position of the device represented in FIG. 4C and FIG. 4D is characterised in that the forming tool 29 has been pivoted downwards by a rotation of the traverse T2 about the axis of rotation D2. In this case, the forming tool 29 has applied the fin seam 17 to the gable surface of the package 16. In FIG. 4D, the purpose of the recess 33 provided in the support 32 of the forming tool 29 is discernible: The recess 33 serves to ensure that the package 16 is not touched in the region of an overcoated hole (OCH) in order not to mechanically or thermally damage the package 16 in this particularly sensitive region such that the subsequent application of a dispensing element with screw cap in this region of the package 16 is simplified.

LIST OF REFERENCE NUMERALS

1: Blank
2.2': Fold line
3: Sleeve surface
3A, 3B: Partial region (of the sleeve surface 3)
4: Base surface
5: Gable surface
6: Sealing surface
7, 7B, 7G: Rectangular surface
8: Triangular surface
9: Main gable surface
10: Secondary fold line
11: Front edge
12: Embossed line
13: Package sleeve
14: Longitudinal seam
15: Ear
16: Package
17: Fin seam
18: System
19: Conveyor apparatus
20: Cell
21: Device for pre-folding
22: Device for filling
23: Device for sealing
24: Device for gable shaping
25: Device for reshaping the gables
26: Mechanical connection
27: Gable folder
28A, 28B: Ear folder
29: Forming tool
30: Drive
31: Mould carrier
32: Support
33: Recess
A: Distance (of cells 20)
D1, D2, D2: Axis of rotation
E4: Corner point (of the base surface 4)
E5: Corner point (of the gable surface 5)
H1, H2, H3, H4: Lever arm
L4: Length (of the base surface 4)
L5$_{min}$: Minimum length (of the gable surface 5)
L5$_{max}$: Maximum length (of the gable surface 5)
S: Tear line
SB: Contact point (of the base surface 4)
SG: Contact point (of the gable surface 5)
T: Direction of transport
T1, T2: Traverse
X: Longitudinal direction
Y: Vertical direction
Z: Transverse direction

The invention claimed is:

1. A device for reshaping gable surfaces of packages with a slanted gable, comprising:

a conveyor apparatus with cells fastened thereto for receiving the packages and for transporting the packages along a direction of transport, at least one gable folder for folding a fin seam in the gable region of the packages and at least two ear folders for folding ears in the gable region of the packages, wherein both the gable folder and the ear folders are mounted in a movable manner relative to the conveyor apparatus and the packages transported therewith, wherein at least one forming tool for reshaping the fin seam in the gable region of the packages, wherein the forming tool is mounted in a movable manner relative to the conveyor apparatus and the packages transported therewith, and wherein the forming tool is movable to an open position, in which the forming tool does not touch the packages and the packages can be moved under the forming tool in the direction of transport without collision.

2. The device according to claim 1, wherein the forming tool for reshaping the fin seam has at least two-dimensional mobility.

3. The device according to claim 1, wherein a traverse which is arranged above the cells and extends along a transverse direction running transversely to the direction of transport.

4. The device according to claim 3, wherein the traverse is mounted in a movable manner relative to the conveyor apparatus and the packages transported therewith.

5. The device according to claim 3 wherein at least two forming tools for reshaping the fin seam in the gable region of the packages, wherein all forming tools are mounted next to one another on the traverse in the transverse direction.

6. The device according to claim 1, wherein the gable folder and the forming tool and/or traverses of the gable folder and the forming tool are coupled to one another by a mechanical connection and have a common drive.

7. The device according to claim 1, wherein the forming tool comprises a mould carrier and a support.

8. The device according to claim 1, wherein the cells have a distance from one another and that the forming tool has at least twice the cell distance to the gable folder and/or to the ear folders.

9. A method for reshaping gable surfaces of packages with a slanted gable, comprising the following steps:

a) Providing packages with slanted gables, b) Folding a fin seam in the gable region of the packages using a gable folder, c) Folding ears in the gable region of the packages using two ear folders, and d) Reshaping the fin seam using a forming tool, e) moving the forming tool to an open position, in which the forming tool does not touch the packages and the packages can be moved under the forming tool in a direction of transport without collision, wherein, in step d), the forming tool is moved relative to a conveyor apparatus and the packages transported therewith.

10. The method according to claim 9, wherein the conveyor apparatus comprises cells fastened thereto and the packages are received by the cells, and moving the packages by the conveyor apparatus with the cells fastened thereto.

11. The method according to claim 10, wherein step d) is performed at a location that has at least twice a cell distance from the location where step b) and/or step c) is performed.

12. The method according to claim 9, wherein the packages are moved intermittently.

13. The method according to claim 9, wherein the packages stand still during step b), during step c) and during step d).

14. The method according to claim 9, wherein, in step d) the gable surfaces of at least two packages are reshaped simultaneously.

* * * * *